US008599080B2

(12) United States Patent
Apostolos et al.

(10) Patent No.: US 8,599,080 B2
(45) **Date of Patent: *Dec. 3, 2013**

(54) WIDE BAND EMBEDDED ARMOR ANTENNA

(75) Inventors: John T. Apostolos, Lyndelborough, NH (US); William Mouyos, Windham, NH (US); Randall R. Lapierre, Hooksett, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/473,132

(22) Filed: May 16, 2012

(65) Prior Publication Data

US 2012/0293381 A1 Nov. 22, 2012

Related U.S. Application Data

(60) Provisional application No. 61/486,956, filed on May 17, 2011.

(51) Int. Cl.
*H01Q 1/32* (2006.01)

(52) U.S. Cl.
USPC ..... 343/713; 343/795

(58) Field of Classification Search
USPC ..... 343/711, 713, 795, 815, 817, 818, 873
See application file for complete search history.

(56) References Cited

U.S. PATENT DOCUMENTS

| | | | | |
|---|---|---|---|---|
| 3,152,330 | A * | 10/1964 | Chatelain | 343/705 |
| 6,052,098 | A * | 4/2000 | Killen et al. | 343/795 |
| 6,300,906 | B1 * | 10/2001 | Rawnick et al. | 343/700 MS |
| 6,329,958 | B1 * | 12/2001 | McLean et al. | 343/787 |
| 7,129,904 | B2 * | 10/2006 | Chen | 343/795 |
| 2011/0260935 | A1 * | 10/2011 | Bortoin et al. | 343/713 |
| 2012/0293381 | A1 * | 11/2012 | Apostolos et al. | 343/713 |

* cited by examiner

*Primary Examiner* — Tho G Phan
(74) *Attorney, Agent, or Firm* — Robert K. Tendler; Daniel J. Long

(57) ABSTRACT

An extremely thin embedded antenna for an armor-carrying vehicle utilizes a dipole driven element to the inside of the armor plate and a parasitically-driven dipole element on top of the armor plate, with the parasitic element providing appropriate forward gain and antenna matching characteristics such that there need be no aperturing of the armor plate in order to feed the antenna. In one embodiment, the bowtie antenna elements are elongated, extended or expanded by outboard antenna sections which are spaced from the distal ends of the corresponding bowties, with a meanderline choke bridging the gap between a bowtie element and its extended portion.

16 Claims, 9 Drawing Sheets

WIDE BAND EMBEDDED ARMOR ANTENNA

RELATED APPLICATIONS

This application claims rights under 35 USC §119(e) from U.S. Application Ser. No. 61/486,956 filed May 17, 2011, the contents of which are incorporated herein by reference.

FIELD OF THE INVENTION

This invention relates to an antenna utilized on armored vehicles and more particularly to an armor-embedded parasitically-fed antenna system.

BACKGROUND OF THE INVENTION

As described in provisional patent application 61/486,956 filed May 17, 2011, it is desirable to provide a thin structure for an antenna embedded in an armor panel and more particularly to provide a parasitic element on top of the armor layer so that when driving the antenna there are no apertures in the armor which would degrade performance. In one embodiment the aperture-less embedded antenna system includes a direct fed dipole on the underneath side of the armor layer such that the armor layer is not pierced. There is an identical dipole on the top of the armor layer that is parasitically fed by the driven dipole. In one embodiment the dipoles are in the form of bowties.

As described in the above-identified provisional patent application, it is desirable to replace antennas such as whip antennas on tanks, armored vehicles and the like with broadband antennas that are conformal to the vehicle itself.

Having a forest of antennas that extend from the armored vehicle is undesirable because they are susceptible to damage and attack. It is therefore desirable to be able to provide an antenna system which is embedded in the armor such that the armor protects the embedded antenna both against explosive attacks and ballistic penetration while at the same time eliminating the need for antenna whips, dashes and the like which are easily blown off with explosive charges, thereby precluding communication with the vehicle.

It is noted that the thin structure of present armor panels presents the greatest challenge to antenna design. Whether the panel is metal backed itself or is mounted on a metal vehicle, the close proximity of a conductive surface to a radiating element creates a ground plane that is too close to the element. As will be appreciated in traditional antenna design, the ground plane is spaced at least a quarter wavelength away from any driven element. However, when dealing with armor for vehicles such as tanks and the like, the spacing between the ground plane and the driven element of the antenna is on the order of hundredths of a wavelength.

While initially thought that this limitation would be a disqualifying factor in the antenna design, it has been shown that a thin antenna structure can be created which does not rely on deep cavities behind the elements. Such structures have been described in U.S. Pat. No. 6,833,815 which relates to Cavity Embedded Meanderline Loaded Antennas. In this patent the antenna described is a conformal antenna which is cavity-backed.

In one embodiment of this Cavity Embedded Meanderline Antenna a bowtie dipole is utilized, with the distal ends of the dipole being coupled to surrounding metal utilizing a meanderline structure. The question becomes how one can better configure such dipole antenna into a thin structure for use with armor plates.

SUMMARY OF THE INVENTION

It has been found that it is possible to completely quantify the electromagnetic characteristics of the armor materials to a result it has been found that one can establish the permittivity and loss of each piece of the armor recipe that affects the effective electrical length and efficiency of the radiating structure. This being said, the dielectric constants of overlying or intermediate materials can be tailored to reduce VSWR and maximize gain and that this can be accomplished by completely characterizing the boundaries between the layers within the armor as well as the boundary to the outside or free space.

While the presence of a dielectric allows one to accommodate the thin armor structure, it has also been found that regardless of the dielectric matching a thin stacked element array is achievable using a driven bowtie dipole to the inside of an alumina tile armor plate and a parasitic element in the form of an identical parasitically driven bowtie located on the outside of the armor plate.

In order to achieve satisfactory embedded antenna performance, in the subject invention a bowtie dipole is used both as the directly driven element and as the parasitically-driven dipole element.

In one embodiment a plurality of panels, each carry a dipole pair, are located side by side, for instance on a tank, and may driven in phase or may be phased to provide a sharp antenna lobe in a given direction. Thus, the gain in a particular direction may be increased with traditional antenna steering. As will be appreciated, for a steerable beam one can obtain increased gain in a particular pointing direction.

With a vertically polarized four panel array, the gain in the horizontal direction has been found to go from approximately a −7 dBi at 30 MHz to over 12 dBi at 150 MHz. It has also been found that with alumina tile as the primary armor layer on top of a spaul layer, in turn backed by a rubber insulating layer and in turn mounted to the ground plane provided by the exterior of a vehicle, the VSWR across at least the 225-450 MHz band was found to be 3:1 or less.

In summary, an extremely thin embedded antenna for an armor-carrying vehicle utilizes a dipole driven element to the inside of the armor plate and a parasitically-driven dipole element on top of the armor plate, with the parasitic element providing appropriate forward gain and antenna matching characteristics such that there need be no aperturing of the armor plate in order to feed the antenna.

BRIEF DESCRIPTION OF THE DRAWINGS

These and other features of the subject invention will be better understood in connection with the Detailed Description, in conjunction with the Drawings, of which.

DETAILED DESCRIPTION

Prior to discussion of the specifics of the subject antenna system, it is noted that the thin structure of the armor panel is the greatest challenge to the antenna design. Whether the panel is metal-backed itself or is mounted on a metal vehicle, the close proximity of a conductive surface creates a groundplane to the radiating element. A conventional design would have the groundplane spaced at least a quarter-wavelength away. However, one is typically dealing with spacing more on the order of hundredths of a wavelength. It has been found that this is not a disqualifying factor in antenna designs. The present antenna array had a goal of creating thin antenna structures that do not rely on deep cavities behind the elements to integrate an antenna with the armor on a vehicle.

Being able to completely quantify the electromagnetic characteristics of the armor materials is essential to making accurate predictions of antenna performance. The permittivity and loss of each piece in the armor recipe affects the effective electrical length and efficiency of the radiating structure. The dielectric constant (permittivity) and permeability of all the armor constituent materials are first measured. With this information the boundaries between layers within the armor as well as the boundary to the outside (freespace) are characterized. As part of the subject invention it has been found that the presence of a dielectric allows accommodation of the thin structure desired for an armor solution. It also allows antenna requirements at lower frequencies to be met. It has also been found that this benefit is extended even lower in frequency with the inclusion of ferrous materials or meta-material layers within the armor panel.

Figure 1:
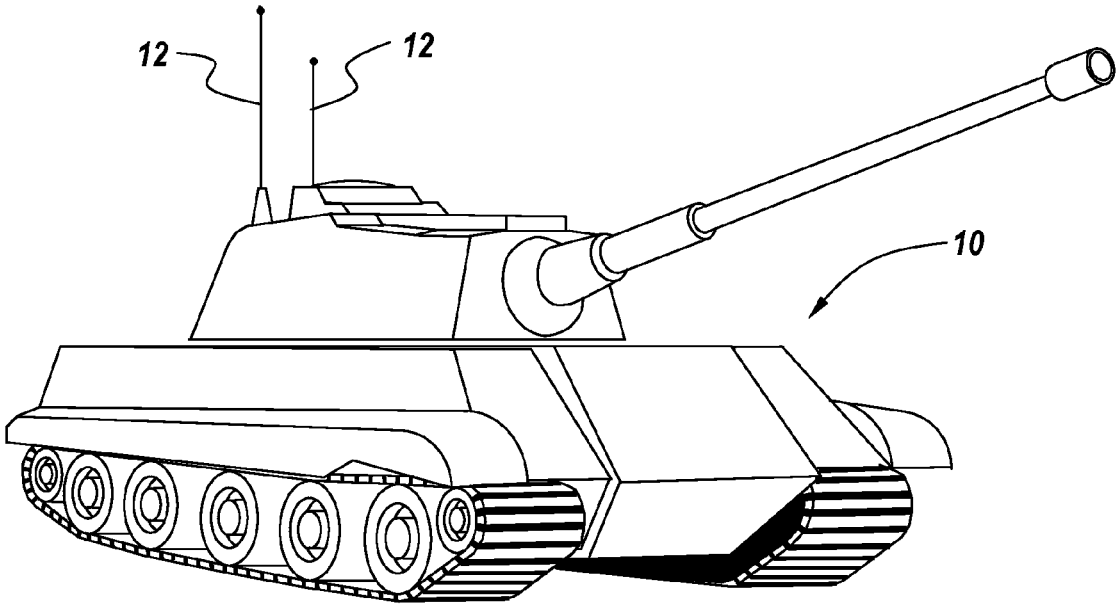
Fig. 1 (Prior Art)
FIG. 1 is a diagrammatic illustration of a tank sporting a pair of prior art whip antennas which are exceedingly vulnerable to enemy fire and which are subject to damage.

Referring now to FIG. 1, in the prior art a tank 10 or other armored vehicle may be provided with a number of whip antennas 12 which extend above the vehicle and which are tuned to various frequency bands.

The problem with such a configuration is that the whips are extremely vulnerable to explosive destruction as well as being torn off the vehicle by overhead limbs and the like.

It will be appreciated that in order to cover the bands of interest for communication with such a vehicle the number of bands that are required are multiple. It would be desirable to have communication antennas for such vehicles operate in a 225 MHz to 425 MHz band. However, antennas that are wideband enough do not exist other than in whip form.

Figure 2:
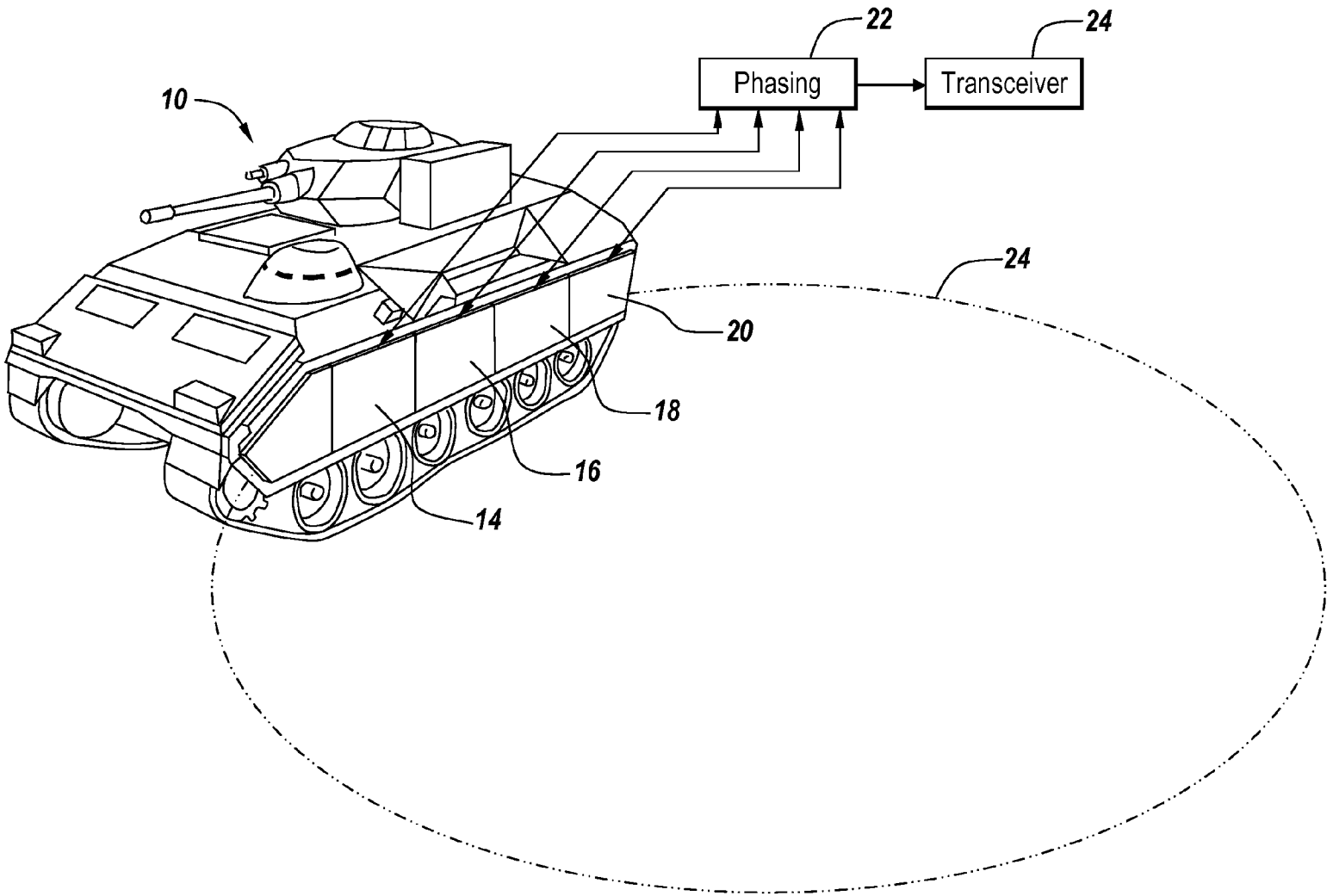
FIG. 2 is a diagrammatic illustration of the utilization of the subject embedded dipoles in a number of adjacent armor panels located on the side of a tank showing the ability to phase the embedded bowties for directional purposes, with the bowties when fed in parallel providing a 180° pattern to each side of the tank.

Referring now to FIG. 2, it is the purpose of the subject invention to provide a conformal embedded antenna structure for vehicle 10 in which embedded antenna structures are provided in plates 14, 16, 18 and 20 that when appropriately phased by a phasing network 22 result in an antenna lobe 24 which as illustrated has a 180° azimuthal coverage. Providing the tank with embedded antenna plates on both sides provides a 360° coverage.

The antennas are capable of being used in a transmit and receive mode such that a transceiver 24 can listen for signals in 180° about the horizon, or can transmit signals from the transceiver through the panel-embedded antennas with an antenna pattern such as that shown by reference character 24.

The challenge therefore is to be able to provide a panel-embedded thin antenna structure, which provides close to 180° coverage per side and yet has an ultra wideband coverage characteristic.

Figure 3:
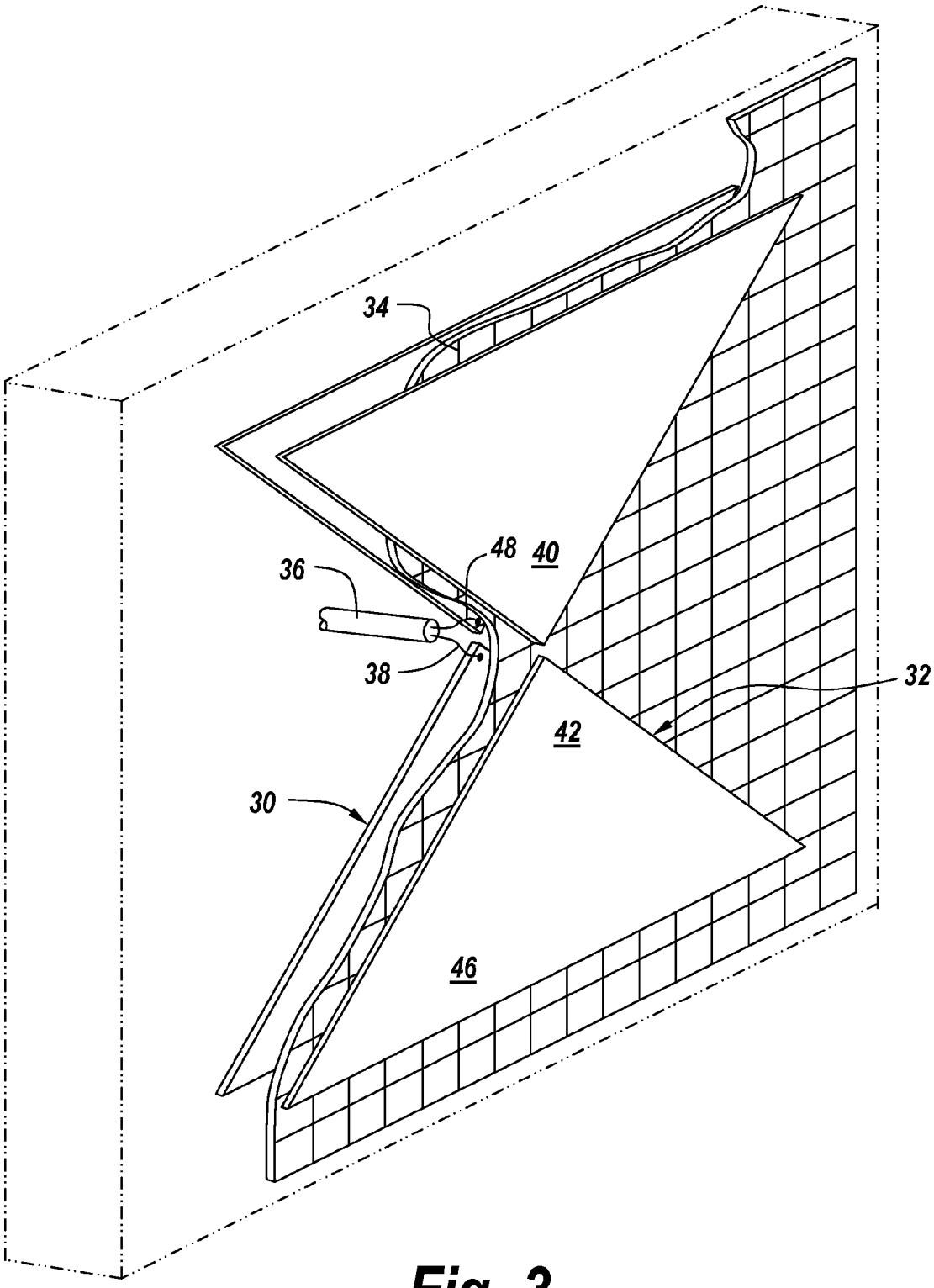
FIG. 3 is a diagrammatic illustration of one of the panels of FIG. 2 illustrating a bowtie driven element to the inside of a armor layer, with an identical bowtie to the outside of the armor layer.

In order to do so and referring now to FIG. 3, a pair of dipole antennas 30 and 32 are located to either side of an alumina tile armor layer 34 such that the inner dipole 30 is driven by a transmission line 36 having conductors 38 and 40 which do not pierce the armor layer 34 tiles. The result is an unapertured armor layer in which energy is coupled to an inner bowtie without having to provide holes in the armor plate.

Figure 4:
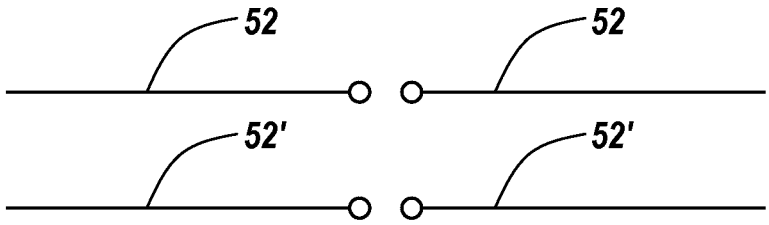
FIG. 4 is a diagrammatic illustration of the spaced apart dipoles, with one parasitically feeding the other.

The bowtie 32 is parasitically driven by bowtie 30 such that sufficient gain is achieved over the operating range of the antenna. The electrical arrangement is shown in FIG. 4 in which the first dipole having elements 52 parasitically feeds the second dipole having elements 52'.

Figure 5:
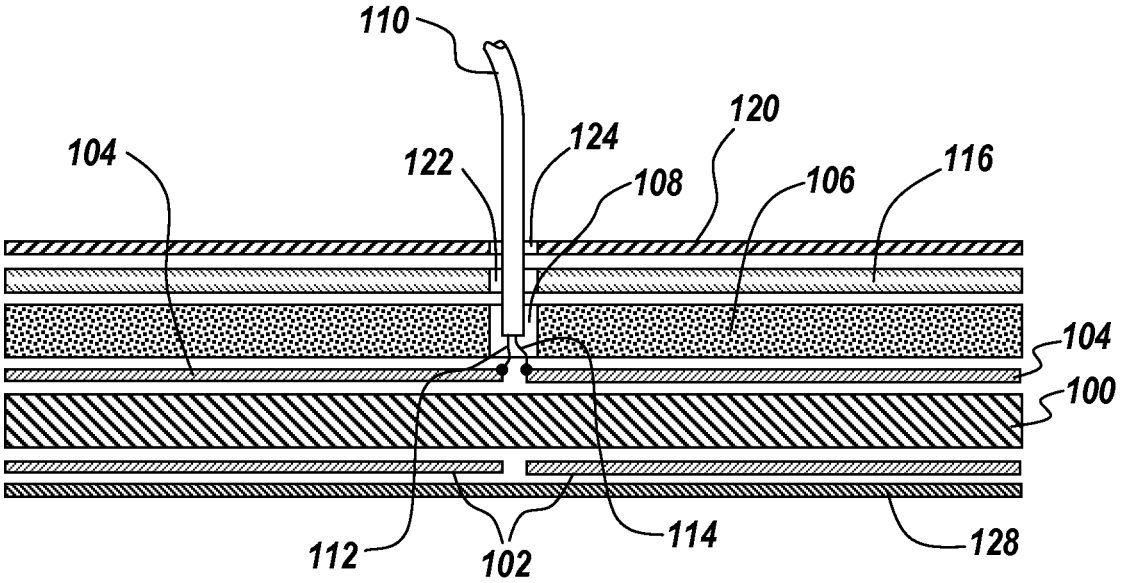
FIG. 5 is a cross sectional view of the dipole structure of FIG. 3 illustrating the feeding of the inner dipole through apertures in a spaul layer and a rubber liner, whereas the armor layer is left unpenetrated.

Referring now to FIG. 5, in one embodiment an armor layer or plate 100 in the form of alumina tiles has a pair of parasitic dipole elements 102 to the outside of this layer. To the inside of layer 100 are identical dipole elements 104 which are to the outside of a spaul layer 106 which may be for instance made of Spectra®. Spaul layer 106 is apertured at 108 to provide access for feedline 110 and its conductors 112 and 114 to connect to driven dipole elements 104.

In one embodiment an apertured rubber liner 116 is provided between spaul layer 106 and ground plane 120, with the rubber liner 116 being apertured at 122 and with the ground plane being apertured at 124.

In a preferred embodiment a radome or electrically transparent shield 128 is utilized to protect the parasitic dipole elements.

In one embodiment, a 24 inch by 24 inch armor panel was provided with ceramic tiles, a Kevlar spaul layer and a radome layer covering the tiles. The driven element was provided as a first metalized layer on top the spaul material, while the top element was patterned on top of the tiles to form the parasitic radiator. For the UHF portion of the antenna the distal edges of the driven and parasitic bowties are 6.0 inches in length, with a 1 inch spaul layer utilized. The ceramic tiles in one embodiment are 0.4 inches thick and the radome layer is 0.010 inch in thickness.

It has been found with this configuration that the UHF antenna formed by dipole elements 102 and 104 operates with sufficient gain and sufficient bandwidth across the 225-450 MHz bands.

Note, what is described for the driven element is also true for the parasitic element.

As noted above, in one embodiment analysis included a 24.0-inch by 24.0-inch armor panel complete with ceramic tiles, a Kevlar® spall layer and a nuisance layer covering the tiles. The driven element is on the first metalized layer on top of the spall material while the top element is a parasitic radiator. The dimensions modeled are 16.0 inches for the driven and parasitic bow ties with a 1.0 inch spall layer. The ceramic tiles are 0.4 inch thick and the nuisance layer is 0.010 inch. The groundplane is directly under the spall layer. Small penetrations are made in the spall layer to allow for the antenna feed. These feeds pose a minimal impact to the performance of the armor since they do not penetrate the ceramic tiles. The patterns for the modeling are shown below in FIG. 10 as vertically polarized Gain patterns.

In this plot, the theoretical limit is the Gain one could achieve with a perfectly matched and lossless antenna. The curve shows the Boresight Gain performance predicted by a preliminary FEM simulation, and is inclusive of material losses and power lost due to mismatch. To reach the expected performance and meet the antenna specifications one matchs the antenna across the frequency band of interest and minimize losses. A solution meeting design requirements is realized by the combination of absorptive materials and resistive loading, optimizing the trade between distributive loss and input impedance match.

To ensure that the finite element analysis was tracked with known theory one looks at the Chu-Harrington limit, which is an estimate of the efficiency of the structure based upon the total volume occupied by the radiating elements.

The relation is: $\text{Efficiency}=(KQ)*(\text{Volume}/\lambda^3)$ where K is a form factor dependent upon the shape of the structure and Q is the quality factor As an example, if it is assumed that the area of the antenna element is 20.0 inches by 20.0 inches, and the band being covered is 225 to 450 MHz; then (with the form factor, K=32) the efficiency is found to be about 50% or −3.0 dB at mid band. If it is assumed that the ground plane is large enough to result in a unidirectional pattern, then the peak directivity should be about 4.0 dBi, which leads to a peak Gain of 1.0 dBi. With broadband designs embedded in dielectric, Q becomes less meaningful. The volumetric requirements can be thought of in this way: the radiation area needs to be large to meet directivity goals, and the depth of the cavity needs to be large to meet efficiency standards. This consideration may conflict with the desire to have thin profile armor, outlining a fundamental trade between volume and antenna performance that is especially sensitive to the form and function of the armor recipe. This consideration leads to the several further trades. In addition to loading within the spall layer, thin dielectric layers above the parasitic element can be engineered to better match the launched wave through the dielectric space and into freespace. This adaptation does increase the overall thickness of the panel, but might be necessary for performance depending on the frequency band.

The trade between the incorporation of the thin dielectric layer over the armor antenna and the parasitic antenna element approach is based on frequency. For the proposed goal of frequencies below 450 MHz, there is a mismatch loss of 1.5 dB due to the discontinuity between the armor and free space. To overcome this mismatch, an impedance matching dielectric layer would have to be approximately 3.3 inches thick. This amount would increase the thickness of the armor, which would have to be traded. Alternatively a driven and parasitic element approach, does not need the impedance-matching layer.

If one were to consider frequencies above 950 MHz, the impedance matching layer would only need to be approximately 0.9 inches thick. In this case it is more desirable to add the matching layer than design a driven and parasitic element antenna.

By way of example of an impedance matching layer composed of five layers of alternating air and dielectric sub-layers with a total thickness of 0.9 inch provides a match through the armor to freespace would be a preferred embodiment.

The predicted performance is dependent on the characterization of the armor materials. There may be some electrical parameters that require control. With accurate electromagnetic characterization of the armor materials and a detailed model of the geometry an antenna solution is optimized, performance may be optimized by close interaction between the antenna and armor designs.

Figure 6:
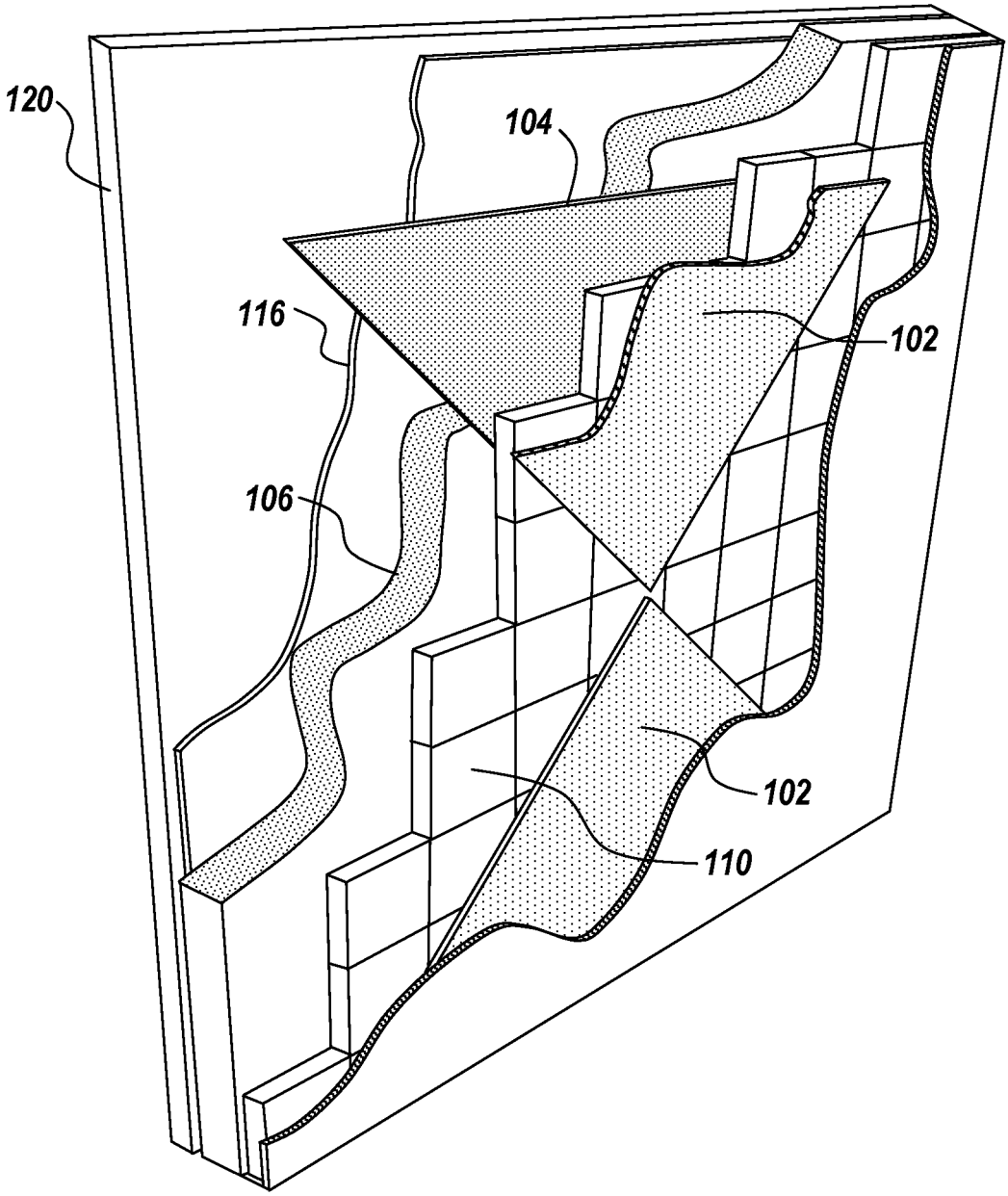
FIG. 6 is a diagrammatic illustration of the embedded thin antenna of FIG. 4 illustrating not only the dipoles which surround the armor layer but also the spaul layer and the rubber liner atop a ground plane.

Referring to FIG. 6, the elements between FIG. 5 and FIG. 6 carry like reference characters, with a FIG. 6 cutaway drawing illustrating the preferred configuration of the subject thin embedded antenna system.

Figure 7:
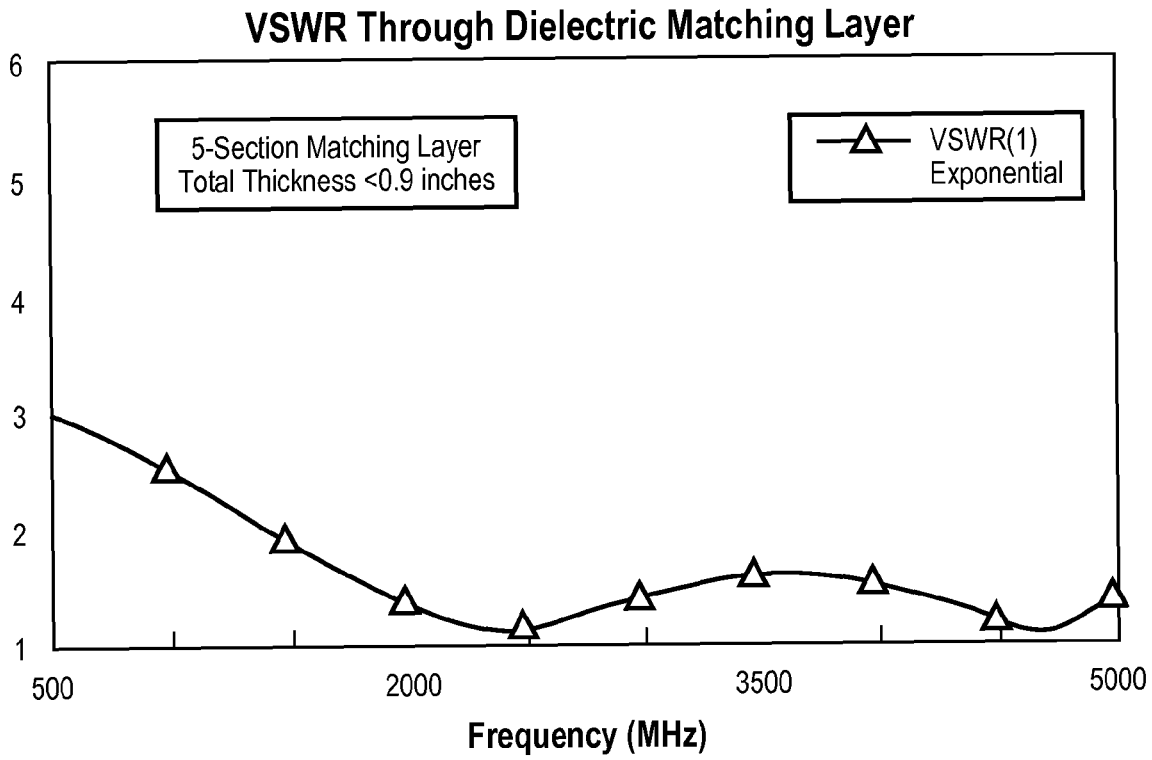
FIG. 7 is a graph showing VSWR through a dielectric matching layer, illustrating that the VSWR can be kept to under 3:1 from 500 MHz to 5,000 MHz.

Referring now to FIG. 7, it has been found that the VSWR through the dielectric matching layer is less than 3:1 all the way from 500 MHz to 5,000 MHz. Thus, it is possible through appropriate dielectric matching techniques to make the VSWR tolerable across all the bands of interest.

Figure 8:
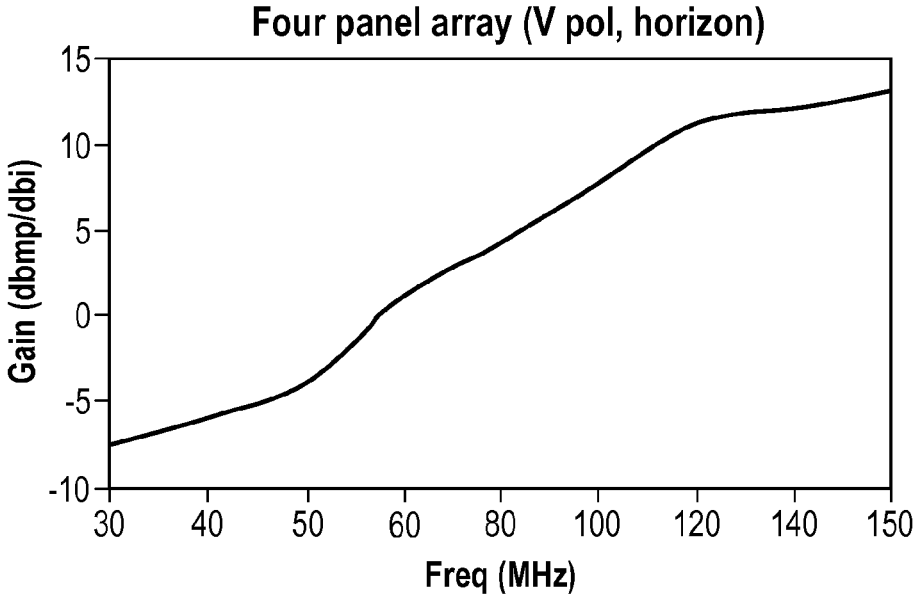
FIG. 8 is a graph showing gain of a four panel array from 30 MHz to 150 MHz.

Referring to FIG. 8, for a four panel vertically polarized array, the gain in the horizontal direction from 30 MHz to at least 150 MHz is from a −6 dB to approximately 14 dB, with the gain measured in terms of dpmp/dBi.

Figure 9:
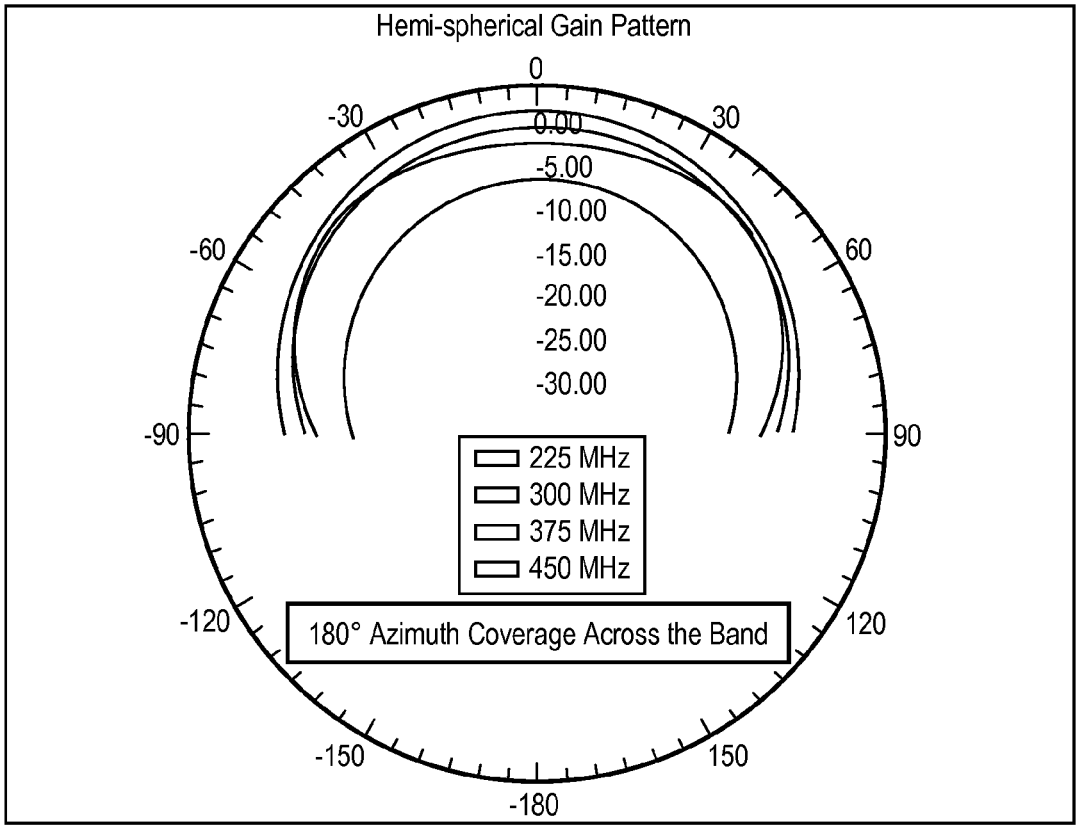
FIG. 9 is a hemispherical gain pattern graph showing 180° azimuthal coverage across selected bands from 225 MHz to 450 MHz corresponding to the UHF operating range of the subject antenna; and, FIG. 10 is a graph showing boresite gain versus frequency for the UHF portion of the subject antenna from 225 MHz to 450 MHz, showing sufficient gain across the UHF band.

Referring to FIG. 9 for the UHF portion of the subject antenna, a hemispherical gain pattern is achievable as illustrated for the 225 MHz band, 300 MHz band, 375 MHz band and the 450 MHz band, with the gains exceeding −6 dB.

Figure 10:
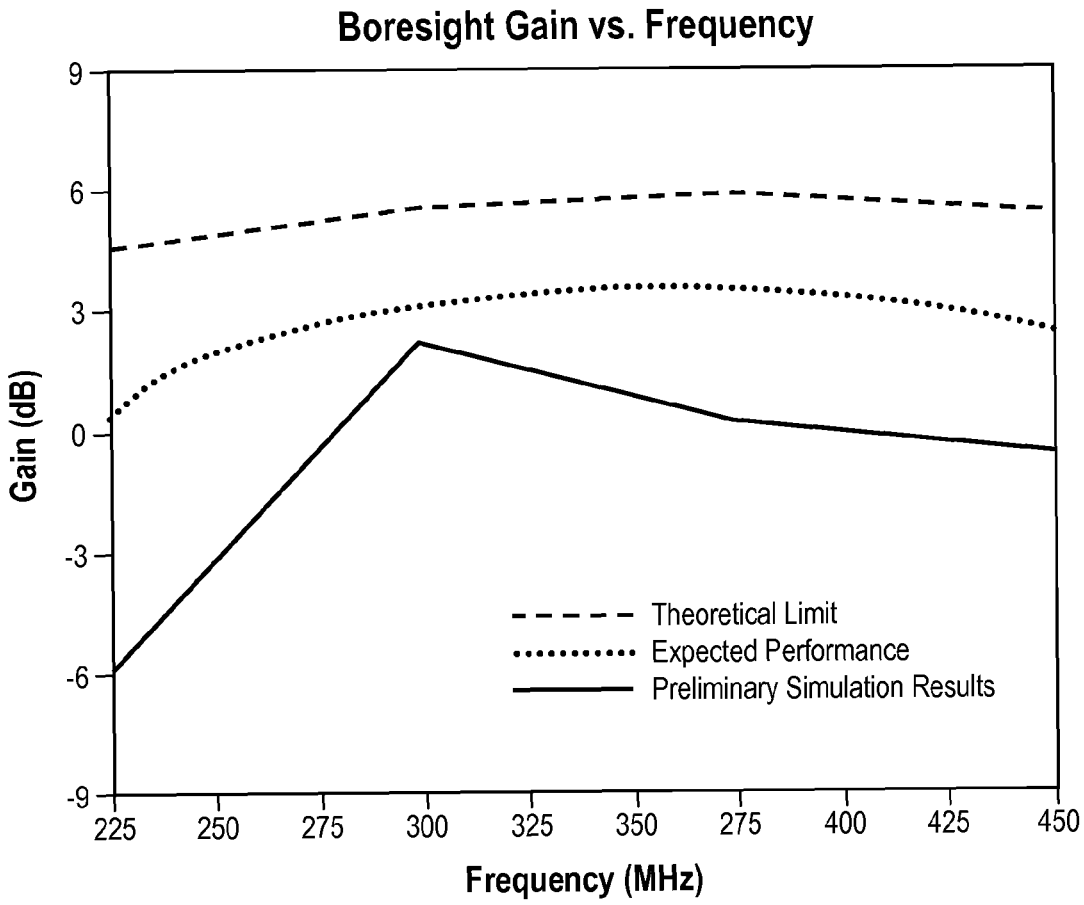

Finally with respect to FIG. 10, boresite gain versus frequency is plotted for a theoretical limit, an expected performance and preliminary simulation results for the UHF portion for the band covered by the subject antenna, namely the 225-450 MHz band. In the best case scenario, the theoretical limit of boresite gain is on the order of 5 dB or higher, whereas the expected gain is between 1 and 3 dB. Finally, preliminary simulation results indicate that at least a −6 dB gain is achievable at the low end of the UHF band, whereas better than zero gain is achievable above approximately 300 MHz.

What is therefore shown is a versatile wideband embeddable antenna system in which a parasitically driven bowtie or dipole exists to the exterior of an armor layer an in which a driven dipole is embedded underneath the armor layer. The purpose of being able to do this is to leave the armor layer unapertured such that its armor protective characteristics are unaltered by the embedding of the subject antenna.

Note the ground plate is directly under the spaul layer with small penetrations made in the spaul layer to allow for the antenna feed. These feeds pose a minimal impact to the performance of the armor since they do not penetrate the ceramic tiles.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A wideband embedded armor antenna comprising:

an armor layer mounted to a vehicle;

a planer driver dipole between said armor layer and said vehicle such that said planar driver dipole is interior to said armor layer;

a planar parasitically driven dipole spaced from said planar driver dipole in a different plane from that of said driver dipole and on the outside of said armor layer such that said parasitically driven dipole is driven through said armor layer by said driver dipole on the inside of said armor layer; and, a feed for said driver dipole which does not pierce said armor layer, whereby the antennas is embedded in the armor layer without altering the characteristics of said armor layer.

2. The antenna of claim 1, wherein the frequency band associated with said dipoles includes the UHF band.

3. The antenna of claim 2, wherein said UHF band extends from 225 MHz to 450 MHz.

4. The antenna of claim 1, and further including a spaul layer interposed between said driver dipole and said vehicle.

5. The antenna of claim 4, and further including a rubber liner between said spaul layer and said vehicle.

6. The antenna of claim 1, wherein said dipoles include bowtie shaped elements.

7. The antenna of claim 6, wherein said dipoles include bowtie shaped elements in the form of triangularly-shaped elements.

8. The antenna of claim 1, and further including a number of armor plates attached to the side of said vehicle, each of said armor plates including an embedded driver dipole antenna and an exterior parasitically-driven dipole antenna, and further including a phasing module for driving the antennas.

9. The antenna of claim 8, wherein said phasing module drives said antennas in-phase.

10. The antenna of claim 8, wherein said phasing module phases the feeds for said embedded antennas so as to provide a steerable beam therefrom.

11. A wideband embedded armor antenna comprising:

an armor layer mounted to an armored vehicle;

a planar driver dipole between said armor layer and said vehicle;

a planar parasitically driven dipole spaced from said driver planar dipole in a different plane from that of said driver dipole and on the outside of said armor layer such that said parasitically driven dipole is driven through said armor layer by said driver dipole on the inside of said armor layer; said dipoles operating in the UHF band;

a feed for said driven dipole which does not pierce said armor layer, and, a spaul layer interposed between said driven dipole and said vehicle.

12. The antenna of claim 11, and further including a rubber liner between said spaul layer and said vehicle.

13. The antenna of claim 11, wherein said dipoles include bowtie shaped elements in the form of triangularly-shaped elements.

14. The wideband embedded armor antenna of claim 11 and further including a number of armor plates attached to the side of said vehicle, each of said armor plates including an embedded driver dipole antenna and an exterior parasitically-driven dipole antenna, and further including a phasing module for driving the antennas.

15. The antenna of claim 14, wherein said phasing module drives the embedded antennas in-phase.

16. The antenna of claim 14, wherein said phasing module phases the feeds for said embedded antennas so as to provide a steerable beam therefrom.

* * * * *